United States Patent [19]

Tschirky

[11] 3,982,858

[45] Sept. 28, 1976

[54] SEGMENTED STATOR FOR PROGRESSIVE CAVITY TRANSDUCER

[75] Inventor: John E. Tschirky, Long Beach, Calif.

[73] Assignee: Smith International Corporation, Inc., Newport Beach, Calif.

[22] Filed: July 11, 1975

[21] Appl. No.: 595,053

Related U.S. Application Data

[63] Continuation-in-part of Ser. No. 415,754, Nov. 14, 1973, abandoned, and a continuation-in-part of Ser. No. 433,540, Jan. 15, 1974, Pat. No. 3,912,426.

[52] U.S. Cl. ..... 418/48; 29/156.4 WL; 175/107

[51] Int. Cl.[2] ..... F04C 1/06

[58] Field of Search ..... 418/48; 29/156.4 WL; 175/107

[56] References Cited

UNITED STATES PATENTS

| | | | |
|---|---|---|---|
| 3,879,094 | 4/1975 | Tschirky | 418/48 |
| 3,912,426 | 10/1975 | Tschirky | 418/48 |

*Primary Examiner*—C. J. Husar
*Attorney, Agent, or Firm*—Philip Subkow

[57] ABSTRACT

This invention relates to progressing cavity fluid motors with multiple segmented stator elements connected in series to provide a fluid passageway from the input of the initial stator of the series to the output of the terminal stator of the series; the rotor elements in each stator are connected together for simultaneous rotation.

6 Claims, 7 Drawing Figures

SEGMENTED STATOR FOR PROGRESSIVE CAVITY TRANSDUCER

This application is a continuation in part of application Ser. No. 415,754, filed Nov. 14, 1973, now abandoned and Ser. No. 433,540 filed Jan. 15, 1974 and now U.S. Pat. No. 3,912,426.

This invention relates to progressive cavity transducers composed of a helicoidal rotor and a complimentary helicoidal stator. When the rotor is rotated by an external force, the transducer acts as a pump, moving fluid from an inlet to an outlet connection to the stator. When the fluid is forced to flow between the stator and the rotor from the inlet to the outlet, the transducer acts as a motor delivering rotary power at the end of the rotor adjacent the discharge end of the fluid from the stator.

In a well-known form of such transducer, both when acting as pumps and when acting as motors, the stator is formed of an elastomer hereinafter referred to as a rubber, bonded to a steel housing.

Since the rotor of the transducer rotates in an eccentric manner, moving from side to side inside the stator, it is necessary to convert this motion into a true rotation about a fixed axis so that power may suitably be imparted to or taken from the motor. This is accomplished by connecting the end of the rotor to a connecting rod by means of a universal joint and connecting rod to a shaft by means of a second universal joint to permit the shaft to rotate about a true axis. Such motors have been for many years used in bore-hole drilling.

The use of hydraulic motors as described above in bore-hole drilling, especially in drilling for oil and gas but also mining operations, has been a standard procedure in the art. Such motors are employed to rotate drills for boring in the earth. The motors may be used for an oil-field operation, such as tube cleaning, milling operations, and other conventional oil-field operations where it is desired to rotate a rod at the end of which a tool is to be rotated. Such motors are referred to as in-hole drills when designed to be run at the end of a pipe and adjacent to the drill bit. In the usual case, the rotor of the motor and the drill bit rotate with respect to a stator which, in turn, is connected to the conventional drill string composed, in the case of the drilling of well bores, of a "kelly," drill pipe, and drill collar as required. The string extends to the surface with the kelly mounted in the rotary table. Where the in-hole motor is used in drilling, the liquid is the usual drilling fluid, i.e., mud or gas. It serves its usual function in the drilling operation, returning to the surface carrying the cutting resulting from the drilling operation. For this purpose, it is necessary to provide the necessary fluid volumetric velocities (gallons per minute, G.P.M.) at the bit nozzles; and the necessary pressures at the nozzle so that the cuttings may be moved through the annulus between the drill string and the bore hole wall and thus to the surface.

In motors used in connection with the earth-drilling operations, the pressure drop across the stator may be of the order of several hundred pounds with the drilling mud flow through the stator, from 300 to about 600 G.P.M., the total pressure at the outlet of the stator depending upon the depth, nature of the mud, size of the tool, design of the nozzles of the bit. The bit manufacturer usually supplies a recommended nozzle pressure drop to give the required lifting effect. It has been observed in transducers and particularly in motors which deliver a substantial torque effort at the drive shaft that the rubber of the stator frequently fails near the fluid outlet point of the stator, and this usually occurs in the lower third of the stators.

This effect appears to be related to the working of the rubber by the eccentric motion of the motor and the magnitude of the pressure drop across the motor. The resultant hysteresis in the rubber deleteriously affects the properties of the rubber.

An additional problem with rubber stators is in the influence of the geothermal effect. The temperature in the bore hole may range up to several hundred degrees F. above ground temperature, depending on the depth. This adds to the heat developed by the working of the rubber, due particularly to the low heat conductivity of the rubber, which is thus not readily carried away by the circulating mud.

Despite the cooling effect of the fluid, this temperature taken together with the working of the rubber which develops a hysteresis in the rubber, operates to impair the physical properties of the rubber. The result is a reduction in the life of the stator, and it is frequently necessary to replace stators with undue frequency which may be more frequent than any other effect requiring the withdrawal of the motor from operation and thus adding to the cost of operations.

The result is a loss of portions of the rubber which break away from the body of the rubber called "chunking" usually at its lower third or it may strip away from the encasing housing due to bond failure, or both may occur.

When this occurs, the motor must be disassembled and a new stator installed. This stator must, of course, have the necessary pitch to complement the rotor and give the required pressure drop.

The torque developed is the greater the greater the effective pressure drop across the stator. For any given throughput, i.e., G.P.M., the pressure drop will be the greater the greater the length of the stator, the less the leakage factor and the greater the diameter of the rotor which requires a greater diameter stator, all other design parameters being the same.

However, there is a practical limit on how large a stator can be fabricated due to difficulties in molding the stator and bonding the stator rubber to the housing.

Molding of the rubber to produce a successful bond to the housing and the necessary helical configuration at its surface becomes more difficult as the diameter of the stator or its length increase.

However, for many uses, it is desirable to develop a greater torque than is now practically available.

Where the motor is used as a down-hole motor in earth boring, as stated above, the requirements of the system include a sufficient flow, i.e., gallons/minute (G.P.M.) of mud or other fluid flow in order to establish the necessary velocity through the bit orifices and thus the desirable fluid velocity in the annulus to raise the detritus. This requires a sufficient pressure at the output of the stator so as to provide the necessary pressure and volumetric flow of the fluid at the bit nozzles.

Since for any fluid rate, gallons per minute, in any particular stator-rotor combination, the revolutions per minute (r.p.m.) is fixed, being directly proportional thereto, the torque is proportional to the pressure drop across the stator. These considerations influence the minimum pressure drop which can be tolerated and obtain the necessary fluid velocities and pressures at the bit nozzles.

In order to increase the torque, the product of the eccentricity (E) and the rotor diameter (D) and the stator pitch ($P_s$) and the effective pressure drop ($\Delta p$) across the stator must be increased, since the torque is directly proportional to this product. In the case of oil-well or other bore-hole drilling, the size of the bore hole fixes the size of the diameter of the housing of the motor; and this, in turn, fixes the diameter (D) of the rotor of circular cross section and the eccentricity (E). The increase in the pressure drop ($\Delta p$) may be obtained by increasing the flow resistance through the stator by increasing the length of the stator. While this will result in an increase in the torque, it may be impractical because of molding problems. If the torque is increased by making the product ($E \times D \times P_s$) greater, the r.p.m. is decreased, at a constant G.P.M.

This dichotomy has introduced a practical limitation in the power available from motors of this character when used as bore-hole in-hole motors. This limitation taken with the reduction in stator life resulting from use of excessive pressure drop has been one of the limitations in this technology.

STATEMENT OF THE INVENTION

My invention solves the problem by making the torque (TP) and horsepower (HP) in the above transducers independent of the stator pitch length, rotor diameter, eccentricity and pressure drop across the transducer. It also to a large measure solves the problem of the deterioration of the rubber resulting in chunking and stripping and thus increases the life of the stator element.

An additional and critical problem as stated above is the deterioration of the rubber resulting in the chunking of the rubber and the stripping away of the rubber from the housing, previously referred to. This, as I have found, is associated with excessive pressure drops across the stator. It is believed that this deterioration is a result of the working of the rubber which in addition to the loading of the rubber by the eccentric motion of the rotor described above results in the generation of heat and a deterioration of the rubber.

By reducing the pressure drop across the unitary stator-rotor combination of the prior art, while maintaining the same terminal pressure, that is, in a transducer used as an in-hole motor, when the pressure at the bit nozzles is maintained at the required value, an increase in the life of the stator results.

However, to accomplish this reduction in pressure drop in the prior art rotor-stator combinations, without changing the other parameters of the system, the torque which is developed is reduced. I may reduce the G.P.M. throughput and thus reduce the pressure drop, but this may be impractical because of other requirements for such throughput as described above. Furthermore, the reduction in the throughput, keeping the other design parameters constant, reduces the r.p.m.; and, therefore, the horsepower is reduced.

I accomplish the increase by using multiple stators connected in a series array. I connect the stators of the array in series so as to establish a flow path from the input to the initial stator through the succeeding stators to the output from the last stator of the array. The rotor of the first stator unit is connected to the rotor of the succeeding units in series so that the rotors rotate together.

The rotor in each stator is the same form and dimension and is rigidly connected to the rotor in all the other succeeding stators or is made unitary. The rotor at its terminal end as it exits the last of the stators is connected by universal joint and connecting rod to the shaft. The eccentricity of the stator cavity in the preferred bifoil form of the stator cavity and the rotor in each stator is the same in all the array of stators.

The above relationship between torque and pressure drop assumes that there is no bypass of the fluid between the rotor and stator, that is, that all of the fluid passes through the progressing cavities. Any bypass thus reduces the effective pressure drop ($\Delta p$). The hydraulic efficiency depends on the percentage of the G.P.M. which is fed to the stators which passes through the cavities. The effective pressure drop ($\Delta p$) is equal to the measured pressure drop across the stator ($\Delta p$) at the developed torque, multiplied by the efficiency, i.e., the leakage factor (K).

Preferably, however, it is desirable that the product of the parameters $D \times E \times P_s$ be all substantially the same. The torque developed at each rotor element is directly proportional to the above product multiplied by the effective pressure drop ($\Delta p$) across the rotor-stator element.

This consequence arises from the fact that the r.p.m. is inversely proportional to the product at a fixed gallons per minute. If the r.p.m. is less than is required for the greater value of the product, the excess is forced to be bypassed.

There are further practical difficulties arising from such interdependence if there is a difference in the above product ($D \times E \times P_s$) of the stator-rotor elements. If the product ($D \times E \times P_s$) be greater than in adjacent stator-rotor element, while the gallons per minute passing through the stators be the same, some of the fluid will bypass the progressing cavities and be forced through the stator between the stator and rotor while the remainder is passing through the progressing cavities at a reduced rate proportional to the lower value of the product ($D \times E \times P_s$). This excessive leakage reduces the efficiency of the rotor, i.e., the value of K and reduces the available torque for the total G.P.M.

In order to minimize the leakage at each stator-rotor element, I, therefore, design the rotor-stator elements of the transducer so that the eccentricities of each stator-rotor element of the transducer be substantially the same, and the product ($D \times E \times P_s$) of the rotor, diameter, eccentricity and stator pitch length for each stator rotor be substantially the same in each of the elements.

Since the same volume of fluid passes through all the stators in series and the r.p.m. of the rotor elements are all alike, the product $D \times P_s$ must also be the same for each stator-rotor element. This relationship will hold although the individual values of D and $P_s$ vary as between the elements of the transducer.

Since, for practical reasons as described above, it is desirable to have all of the rotor-stator units interchangeable, the pressure drop across each unit will be substantially the same; since the fluid flow is the same in each unit, the torque contribution developed at each rotor-stator assembly will be the same and no undue twist will be developed at the rotor between stators. Because the pitch of the stator-rotor elements and the diameter of the rotor, and the eccentricity of all of the rotor-stator elements are alike, the stators will all be interchangeable.

If the rotor is made of uniform diameter and pitch, a single integral rotor may be used and is preferred.

One of the practical advantages of the transducers of my invention is that any desired torque may be developed by adding rotor-stator stages. Each stage being of modest length, they may be readily molded by presently available molding techniques, as has been conventional in this art. While theoretically one unitary long stator may function to give the desired pressure drop and torque in the place of the multiple stators, there is a practical impossibility since there is a practical limit to the length of stators of practical eccentricity and pitch which modern rubber technology may produce.

By breaking the stator into small segments, the problem of molding rubber stators that will resist destruction is made easier than in the case of a long stator. Not only will the life of the stator be improved, the difficulty of molding the stator is minimized and the replacement of stators facilitated.

Should, however, failure occur in any stator array employing my invention, it is merely necessary to strip the damaged stator segment from the stator array and replace it.

This invention will be further described in connection with the following figures which illustrate one embodiment of my invention and my presently preferred embodiment.

Figure 1:
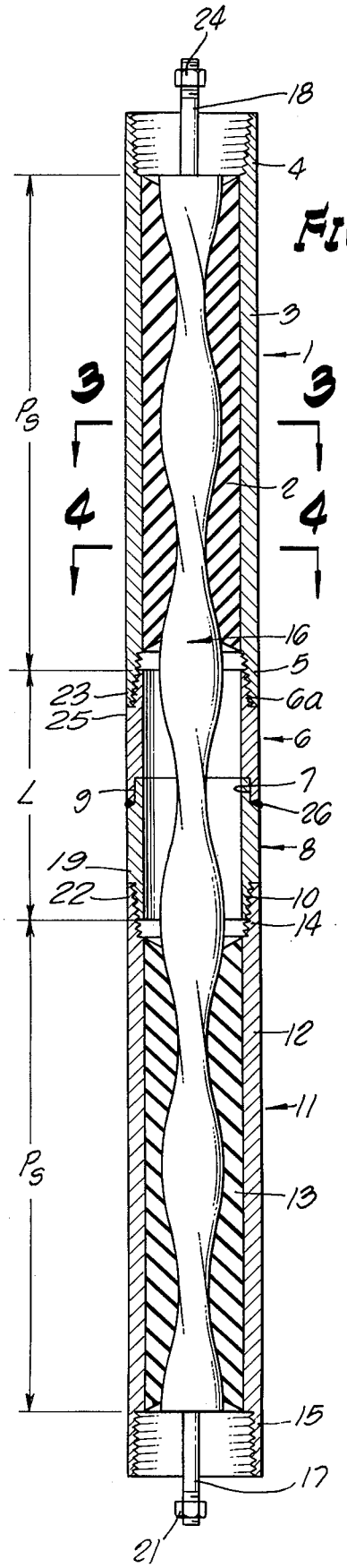
FIG. 1 is a view partially in section of an assembly of a plurality of stators, here illustrated with two stator segments on a form.

The stator segments 1 and 11 are each composed of a housing (see 3 and 12 of FIG. 1) and a stator 2 and 13. The stators have cavities of the same cross section shown as bifoil openings of the same major axis. The stator segments have internal grooves of the same pitch. The construction of such stators by molding them over a form is a well established procedure which has been used for decades.

For the purposes of my invention, the housings 3 and 12 are each provided with threaded box ends 4 and 5 on housing 3 and box ends 14 and 15 on housing 12.

The sub 8 carries a pin end 10 at one end which is screwed into the box 14. The other end of the sub 8 carries an external circular register 9.

In like manner, the sub 6 has a pin end 6*a* at one end and an internal circular register 7.

To assemble these elements, I provide a form 16 having the same pitch and cross-sectional geometry as the cavities of the stator segments. As shown in FIGS. 3–6, they may be a bifoil or any other geometry, such as a trifoil or a quadrafoil (see my copending application Ser. No. 525,828 filed Nov. 21, 1974).

The form 16 carries threaded studs 17 and 18 carrying nuts 21 and 24 which are used for ease of assembly and disassembly of said form 16 in stator segments 1 and 11.

In order that the several stator segments of the array of stators be oriented so that the rotor pitch be matched to the stator pitch at each stator segment, the angular displacement (a) of the major axis A—A of the lower end of the upper stator segment (see FIG. 5) from the major axis A—A of the adjacent upper end of a lower stator is:

$$a = \frac{L}{P_s} \times 360°$$

where $L$ is the separation between the adjacent stator surfaces and $P_s$ is the stator pitch length.

Since the rotor pitch is equal to $P_s/2$, the equivalent angular displacement (a) of the contiguous portion of the rotor would be $$a = \frac{2(L)}{P_s} \times 360°$$

In such case, the rotor surface will be congruent to the stator surface at each extremity of the eccentric motion; that is, the stator pitch will be continuous throughout the array. This relation is advantageous and preferred in order to minimize bypass leakage and consequent reduction of torque.

For such purpose, the stator segments are connected to each other by open tubular subs which have the requisite length. The subs may be in parts, connected to the several stator segments. The parts are designed so that when the stators are assembled in the array the stator segments are oriented in the required angular relation described above. When more than two stator segments are assembled, the stator segments intermediate the end stators carry such sub parts at each end. At the input and output ends of the array, the terminal stators need not carry the subs at their terminal ends. Usually they will be provided with ends suitable for connection to the other parts of the pump or motor in which they will be assembled.

In order to orient the stator segments, I may and preferably employ a form having the congifurations of the stator cavity and pitch. Such forms are employed when molding stators. For the purposes of my invention, I may and preferably will employ a form of length at least as long as the longitudinal array of the assembly of stators of my invention.

The form will permit the stators to be oriented with the stator pitch of each stator segment, and to be angularly oriented so as to provide the proper geometric relation of the stator pitch of succeeding stators of the array.

To assemble the stator segments and to orient them so that the ends of the adjacent stator segments have the proper angular relation to each other, I may and preferably proceed in the following manner:

The sub 6 is screwed onto the stator segment 1 so it shoulders at a recommended makeup torque so that an index mark 25 on sub 6 matches an index mark 23 on the housing of segment 1. In like manner, the sub 8 is screwed into the stator element 11 so it shoulders at a recommended torque so that the index mark 19 on sub 8 matches index mark 22 on the housing of segment 11.

The form 16 is entered through the sub 6 and screwed into the stator segment 2 until the form 16 extends through the end of the stator segment 2. The stator segment 11 is then mounted by passing the sub 8 over the stub 17 and screwing the stator segment over the form 16 until the circular registers 7 and 9 are mated and in abutting relation. The stator segments are thus aligned at the proper angle $a$. A tack weld is provided at 26, care being taken not to injure the rubber of the stators by overheating the subs.

In order to secure the subs and stators in rigid alignment at the proper direction angle $a$, the subs are securely welded by a continuous weld at 26. In order that the weld operation not overheat the stator rubber, the stator segments are disassembled from the tack welded subs 6 and 8. This is accomplished by holding the subs 6 and 8 in a vice and unthreading the subs from the respective stator segments 11 and 1. the full weld is then applied at 26; and since the stator segments have been separated, the stator rubber is not heated.

When the weld has been made and the subs are cooled, the stator segments are screwed into their respective subs; and they are made up to the aforementioned torque values so that the index mark 25 matches the index mark 23 and index mark 19 matches index mark 22.

As stated above, $a$ is the angular displacement of the adjacent ends of the stator segments. This is assured by the form which orients the elements. Since the form is of uniform continuing pitch equal to that of the stators, they will be angularly oriented depending on their separation along the length of the form. In such case, they will be oriented by angular displacement $a$ as stated above since the pitch of the form is that of the stator, to wit, $P_s$.

The relation of the lengths of the subs to the pitch and angle $a$ is given by the above relation:

$$L = \frac{P_s(a)}{360°}$$

The pitch of the stator $P_s$ is twice that of the rotor $P_r$. The individual stator segments may be of any uniform stator pitch. The total length of the subs may be chosen to be any convenient length, provided the orientation of the adjacent subs meets the above criteria, i.e., have their major axis A—A (FIG. 5) displaced at an angle ($a$) from each other. As illustrated in the figures, the stator segments are each of approximately one stator pitch length, and the assembly made up of subs 6 and 8 is of one-half stator pitch length. However, this is not a prerequisite for my invention.

The consequence of such orientation is that at each of the adjacent ends of the stator segments (see FIG. 5) the rotor sees the stator as if it were one continuous stator of a continuous pitch. That is, the stator segments are angularly congruent in that the major axes A—A (FIG. 5) of the adjacent ends are displaced from each other through an angle ($a$).

Where L is equal to half a stator pitch, the angular displacement of the stator ends is 180°.

For a rotor of uniform pitch ($P_r$) equal to $P_s/2$, the separation of the stator may be chosen to be any fraction or multiple of the stator pitch when the separation of the individual stator segments satisfies the above relation.

As will be apparent, the length of the individual stator segments may be any fraction or multiple of the pitch length, provided they are oriented with respect to each other so that when assembled with subs of length as specified the rotor will see a continuous uniform pitch.

The form described above will permit the assembly of the stators so that acting with the subs of proper dimension the terminal ends of the adjacent stator segments will be angularly oriented so that the rotor will see a continuous pitch. It is in this sense that the stator array is said to have a continuous pitch.

Figure 2:
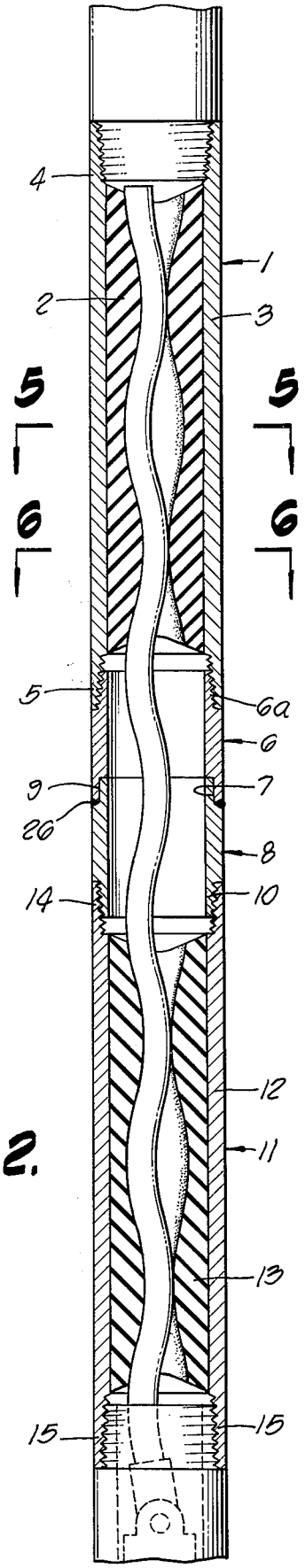
FIG. 2 is a view partially in section of a transducer, here shown as a motor employing the stator array of my invention.
Figure 3:
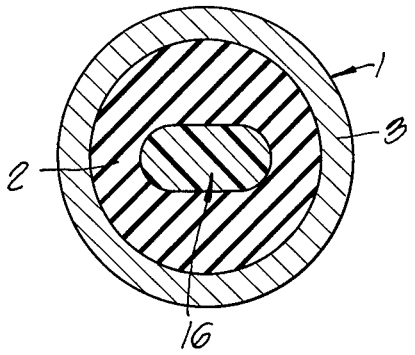
FIG. 3 is a section on line 3—3 of FIG. 1.
Figure 4:
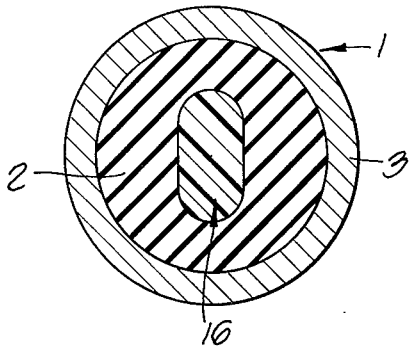
FIG. 4 is a section on line 4—4 of FIG. 1.
Figure 5:
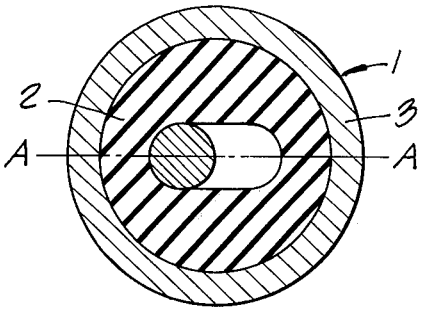
FIG. 5 is a section on line 5—5 of FIG. 2.
Figure 6:
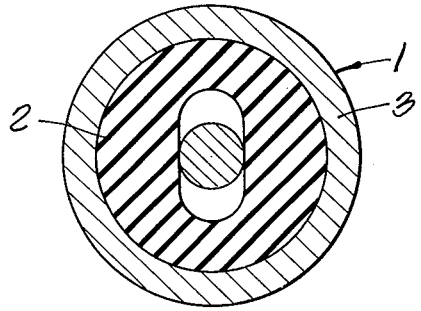
FIG. 6 is a section on line 6—6 of FIG. 2.
Figure 7:
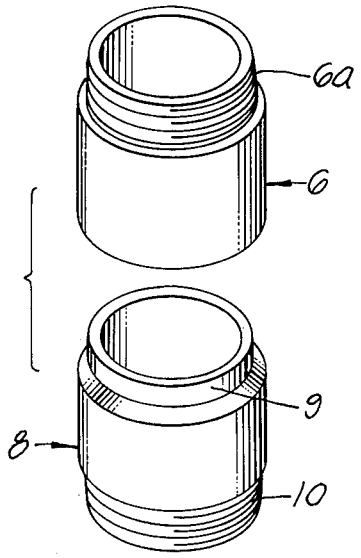
FIG. 7 is a perspective of a detail of FIGS. 1 and 2.

In such case, the rotor, whether unitary or of welded sections of uniform diameter and pitch throughout its length, will fit into and cooperate with the stators as is illustrated in FIG. 2.

The form 16 need not fit the full length of the stator segments, but they preferably should encompass on both segments a full pitch or more than a full pitch as measured on adjacent stator segments. Thus, for example, in the form shown in FIG. 1, the form may be entered into segment 2 for half a pitch and in segment 13 for half a pitch.

I claim:

1. A series stator array for a progressive cavity transducer comprising a plurality of stator segments having a uniform pitch $P_s$, one end of a first stator segment connected to an end of a second stator segment by a hollow tubular connection, one end of said tubular connection connected to the first stator segment and the other end of said tubular connection connected to an end of said second stator segment, the separation of the said ends being related to the angular displacement of the major axis of the stator openings of the adjacent stator segments by $$a = \frac{L}{P_s} \times 360°$$

where ($a$) is the angular displacement and L is the separation between the said ends and $P_s$ is the pitch of the stator in the first and second stator segments.

2. The array of claim 1 in which ($a$) is 180°.

3. The array of claim 1 in which each of the stator segments is equal to the length of the stator pitch.

4. The array of claim 3 in which the separation of the adjacent ends of the stators is one-half the stator pitch.

5. The method of assembly of a stator for a progressive cavity transducer composed of a plurality of stator segments, separated by a tubular connector which comprises threading one of said stator segments over a form having a pitch equal to the pitch of said stator segments, threading a second stator segment over said form and positioning said second stator segment on said form for a distance from the first stator segment equal to $$\frac{P_s \times a}{360}$$

where $P_s$ is the pitch of said form and $a$ is the angular displacement of the major axis of said segments and connecting said stator segments to each other by a tubular connection.

6. A method of assembly of a stator of a progressive cavity transducer composed of a plurality of stator segments having cavities of substantially the same cross section, separated by a tubular connector which comprises connecting a first tubular member to a first stator segment, threading said first stator segment and first tubular member over a form having a pitch equal to the pitch of the said stator segment and a cross section of the same geometry as the cross section of the stator cavity, connecting a second tubular member onto a second stator segment having a pitch equal to the pitch of the first stator segment and a cavity of cross section substantially the same as the cross section of the cavity of the first stator segment, threading said second stator segment and said second tubular member over said form, connecting said first and second tubular member to form a tubular connector, removing said segments from said tubular connector, welding said tubular members together and reassembling the said connector and segments whereby the major axes of the adjacent ends of the stator segments are displaced by an angle $a$ when $$a = \frac{L}{P_s} \times 360°$$

where $a$ is the angular displacement, $L$ is the separation of said ends, and $P_s$ is the stator pitch.

* * * * *

UNITED STATES PATENT OFFICE

CERTIFICATE OF CORRECTION

PATENT NO. : 3,982,858

DATED : September 28, 1976

INVENTOR(S) : JOHN E. TSCHIRKY

It is certified that error appears in the above-identified patent and that said Letters Patent are hereby corrected as shown below:

Column 1, lines 6 and 7 - Delete "now abandoned."

Signed and Sealed this

Seventh Day of December 1976

[SEAL]

*Attest:*

RUTH C. MASON
*Attesting Officer*

C. MARSHALL DANN
*Commissioner of Patents and Trademarks*